US005225029A

United States Patent [19]

Arita et al.

[11] Patent Number: 5,225,029

[45] Date of Patent: Jul. 6, 1993

[54] APPARATUS FOR FEEDING END SECURING TAPES

[75] Inventors: Michio Arita; Kunihiro Sumida; Shigenhisa Shimizu, all of Kanagawa, Japan

[73] Assignee: Fuji Photo Film Co., Ltd., Kanagawa, Japan

[21] Appl. No.: 796,356

[22] Filed: Nov. 22, 1991

[30] Foreign Application Priority Data

Nov. 22, 1990 [JP] Japan ..... 2-319724

[51] Int. Cl.[5] ..... B32B 31/00

[52] U.S. Cl. ..... 156/556; 156/201; 156/354; 156/461; 156/521; 156/522; 242/74

[58] Field of Search ..... 156/200, 201, 461, 519, 156/521, 522, 552, 566, 354, 556; 242/56.6, 74

[56] References Cited

U.S. PATENT DOCUMENTS

| | | | |
|---|---|---|---|
| 2,681,702 | 6/1954 | Kuenn et al. | 242/56.6 |
| 3,420,723 | 1/1969 | Thorp | 156/201 |
| 3,871,943 | 3/1975 | Zodrow | 156/DIG. 31 |
| 4,324,608 | 4/1982 | Klinger | 156/542 X |
| 4,588,463 | 5/1986 | Barber et al. | 156/200 |
| 5,030,311 | 7/1991 | Michal et al. | 156/556 X |

FOREIGN PATENT DOCUMENTS

| | | |
|---|---|---|
| 50-121698 | 3/1975 | Japan . |
| 60-128155 | 8/1985 | Japan . |
| 61-5973 | 2/1986 | Japan . |

OTHER PUBLICATIONS

Patent Abstracts of Japan, vol. 9, No. 286 (M-429)(2009) Nov. 13, 1985.

*Primary Examiner*—David A. Simmons
*Assistant Examiner*—James J. Engel, Jr.
*Attorney, Agent, or Firm*—Sughrue, Mion, Zinn, Macpeak & Seas

[57] ABSTRACT

An apparatus for feeding end securing tapes sequentially feeds a plurality of end securing tapes into an end securing apparatus which simultaneously carries out end securing operations on a plurality of products. The apparatus for feeding end securing tapes comprises a wind-up device for winding up an adhesive tape, which has a non-adhesive surface at a side end. A cutting device cuts the adhesive tape, which has been wound up around the wind-up device, into a predetermined size, and thereby forms a plurality of end securing tapes. A transfer device receives the end securing tapes, which have been formed by the cutting device, from the wind-up device, and transfers the received end securing tapes. A conveyance device receives the plurality of the end securing tapes at predetermined intervals from the transfer device, and conveys the plurality of the end securing tapes, which have been arrayed at the predetermined intervals, into the end securing apparatus.

12 Claims, 2 Drawing Sheets

APPARATUS FOR FEEDING END SECURING TAPES

BACKGROUND OF THE INVENTION

1. Field of the Invention

This invention relates to an apparatus for feeding end securing tapes, with which a plurality of end securing tapes are fed sequentially into an end securing apparatus for simultaneously securing ends of a plurality of products.

2. Description of the Prior Art

In general, after products are obtained, ends of the products are secured to the products. For example, after flexible, long strip-shaped materials (i.e. webs), such as sheets of paper, films, and metal foils, are wound up around cores and web rolls are thereby obtained, ends of the webs are secured to the outer circumferential surface of the web rolls. Heretofore, for this purpose, an adhesive has been applied to the ends of the products or end securing tapes have been adhered to the ends. Various end securing apparatuses for sequentially securing the ends of products with end securing tapes have been proposed in, for example, Japanese Unexamined Utility Model Publication No. 50(1975)-121698 and Japanese Patent Publication No. 61(1986)-5973. One example of such end securing apparatuses comprises an end securing tape adhering means, with which an end securing tape is adhered to an end of a product, and an end securing means, with which the end of the product having the end securing tape adhered thereto is pushed by a rotatable roller against the product and is thereby secured thereto.

In order for the ends of products to be secured sequentially, it is necessary for an apparatus to be used which feeds the end securing tapes sequentially to the end securing apparatus.

One typical example of such an apparatus for feeding end securing tapes comprises an endless belt, which is located in the vicinity of an end securing tape adhering means of an end securing apparatus. A plurality of end securing tapes are placed on the endless belt and sequentially conveyed to the end securing tape adhering means.

However, the conventional apparatuses for feeding end securing tapes have only the function for feeding the end securing tapes. Therefore, with the conventional apparatuses for feeding end securing tapes, a side end of each end securing tape to be fed must be folded such that the end securing tape can be separated easily from the product after it has been applied in order to secure the end of the product to the product. Alternatively, each end securing tape must be treated and imparted with properties such that it can be separated easily from the product. Also, it is necessary for the end securing tapes to be provided with release paper or an equivalent function such that no problem may occur from the adhesive surfaces of the end securing tapes during the operations for processing the end securing tapes. Therefore, the cost of the end securing tapes cannot be kept low.

Additionally, it is desirable that end securing operations can be carried out for a plurality of products with a single end securing apparatus. (For example, it is desired that the end securing operations can be carried out simultaneously for a plurality of web rolls, which are located along a single axis, with a single end securing apparatus). For such purposes, a single apparatus for feeding end securing tapes has heretofore been used for each product. In such cases, for example, when the size of the product (e.g. the cutting width of the web roll) is changed, it is necessary for each of the apparatuses for feeding end securing tapes to be provided with a mechanism, which adjusts the position of each apparatus for feeding end securing tapes. Therefore, the apparatus for feeding end securing tapes cannot be kept simple and cheap.

SUMMARY OF THE INVENTION

The primary object of the present invention is to provide an apparatus for feeding end securing tapes, which enables the cost of end securing tapes to be kept low, which appropriately feeds the end securing tapes into an end securing apparatus for simultaneously carrying out end securing operations on a plurality of products, and which is capable of coping with a change in the sizes of the products.

Another object of the present invention is to provide an apparatus for feeding end securing tapes, which is simple and cheap.

The present invention provides a first apparatus for feeding end securing tapes, wherein a plurality of end securing tapes are sequentially fed into an end securing apparatus which simultaneously carries out end securing operations on a plurality of products, the apparatus for feeding end securing tapes comprising:

i) a wind-up means for winding up an adhesive tape, which has a non-adhesive surface at a side end, ii) a cutting means for cutting said adhesive tape, which has been wound up around said wind-up means, into a predetermined size, and thereby forming a plurality of end securing tapes, iii) a transfer means for receiving said end securing tapes, which have been formed by said cutting means, from said wind-up means, and transferring the received end securing tapes, and iv) a conveyance means for receiving the plurality of said end securing tapes at predetermined intervals from said transfer means, and conveying the plurality of said end securing tapes, which haven been arrayed at said predetermined intervals, into the end securing apparatus.

In the first apparatus for feeding end securing tapes in accordance with the present invention, by way of example, the wind-up means may be constituted such that the adhesive tape, which has the non-adhesive surface at the side end, may be wound up around the outer circumferential surface of a roller capable of rotating around its axis of rotation. The cutting means may be provided with a movable cutter, or the like. The transfer means may be provided with the so-called magic hand, or the like. Also, the conveyance means may be provided with a suction belt, on which a plurality of the end securing tapes are supported at the predetermined intervals and which conveys them into the end securing apparatus.

The present invention also provides a second apparatus for feeding end securing tapes, wherein a plurality of end securing tapes are sequentially fed into an end securing apparatus which simultaneously carries out end securing operations on a plurality of products, the apparatus for feeding end securing tapes comprising:

i) a folding means for folding a side end of an adhesive tape such that an adhesive surface of said side end of said adhesive tape may be brought onto an adhesive surface of the remaining part of said adhesive tape, said folding being carried out when said adhesive tape is unwound from a roll of said adhesive tape, ii) a wind-up means for winding up said adhesive tape, said side end of which has been folded by said folding means, iii) a cutting means for cutting said folded adhesive tape, which has been wound up around said wind-up means, into a predetermined size, and thereby forming a plurality of end securing tapes, iv) a transfer means for receiving said end securing tapes, which have been formed by said cutting means, from said wind-up means, and transferring the received end securing tapes, and v) a conveyance means for receiving the plurality of said end securing tapes at predetermined intervals from said transfer means, and conveying the plurality of said end securing tapes, which have been arrayed at said predetermined intervals, into the end securing apparatus.

In the second apparatus for feeding end securing tapes in accordance with the present invention, by way of example, the folding means may be constituted such that it may be in slide contact with the side end of the adhesive tape and may gradually fold the side end. The wind-up means may be constituted such that the adhesive tape, which has the non-adhesive surface at the side end, may be wound up around the outer circumferential surface of a roller capable of rotating around its axis of rotation. The cutting means may be provided with a movable cutter, or the like. The transfer means may be provided with the so-called magic hand, or the like. Also, the conveyance means may be provided with a suction belt, on which a plurality of the end securing tapes are supported at the predetermined intervals and which conveys them into the end securing apparatus.

With the first and second apparatuses for feeding end securing tapes in accordance with the present invention, a plurality of the end securing tapes are prepared from an adhesive tape, which has a non-adhesive surface at a side end, or from an ordinary adhesive tape. Therefore, the cost of the end securing tapes can be kept low.

Also, the end securing tapes are supported at the predetermined intervals and fed into the end securing apparatus. When the sizes of the products (or the widths of web rolls) are changed, the conditions under which the end securing operations are carried out can be changed immediately by adjusting the timing, with which the end securing tapes are transferred from the wind-up means to the conveyance means.

Additionally, the effects of each of the first and second apparatuses for feeding end securing tapes in accordance with the present invention can be obtained with a single apparatus. Therefore, the first and second apparatuses for feeding end securing tapes in accordance with the present invention can be kept simple and cheap.

DESCRIPTION OF THE PREFERRED EMBODIMENTS

The present invention will hereinbelow be described in further detail with reference to the accompanying drawings.

Figure 1:
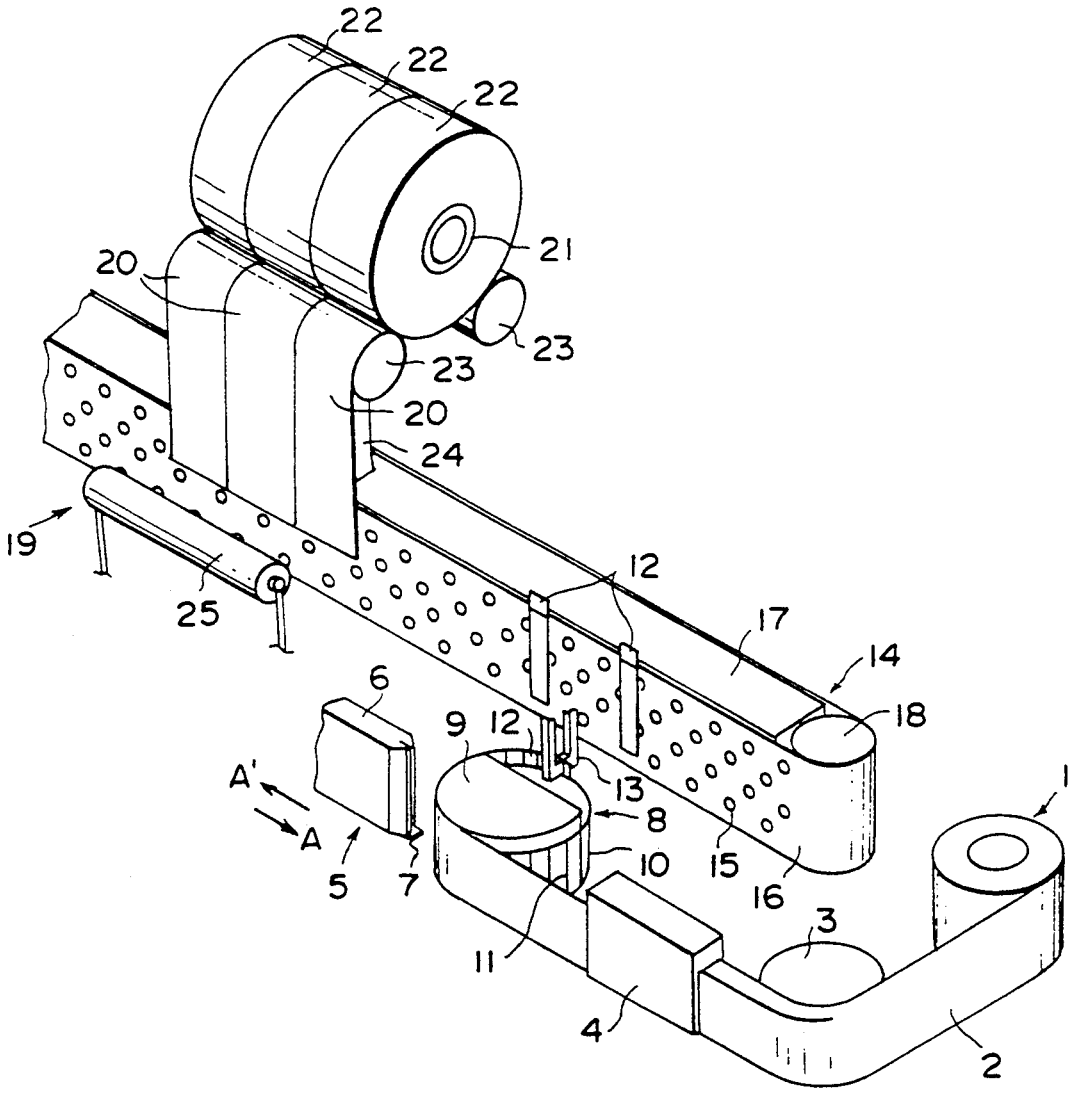
FIG. 1 is a perspective view showing an embodiment of the apparatus for feeding end securing tapes in accordance with the present invention.
Figure 2:
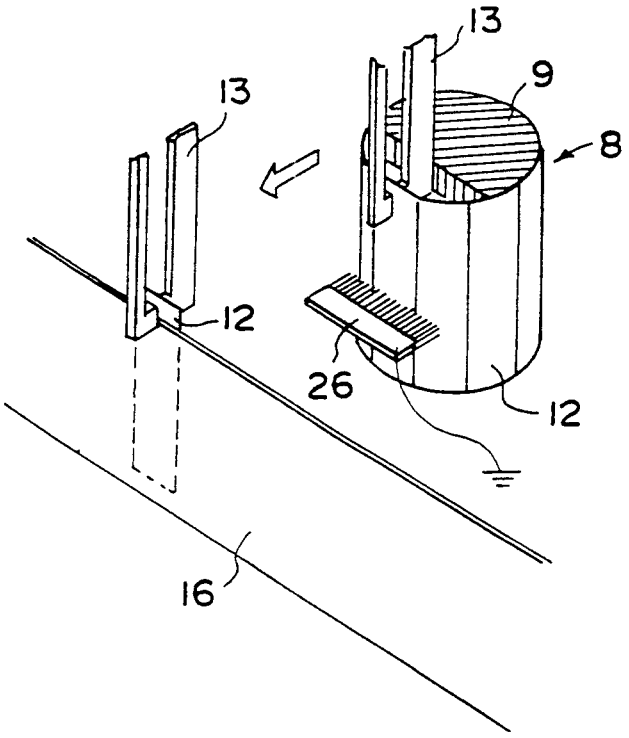
FIG. 2 is a perspective view showing how a transfer hand transfers an end securing tape.

FIG. 1 is a perspective view showing an embodiment of the apparatus for feeding end securing tapes in accordance with the present invention. FIG. 2 is a perspective view showing how a transfer hand transfers an end securing tape.

As illustrated in FIG. 1, this embodiment comprises a folding roller 3, which forms a crease at a side end of an ordinary adhesive tape 2 when the adhesive tape 2 is unwound from an adhesive tape roll 1, and a folding plate 4, which folds the creased side end of the adhesive tape 2 such that an adhesive surface of the side end of the adhesive tape 2 may be brought onto an adhesive surface of the remaining part of the adhesive tape 2. This embodiment also comprises a wind-up roller 8, which winds up the adhesive tape 2 having been folded in the manner described above, and a cutting machine 5, which cuts the adhesive tape 2 on the wind-up roller 8 and thereby prepares a plurality of end securing tapes 12, 12, . . . This embodiment additionally comprises a transfer hand 13, which transfers each end securing tape 12 from the wind-up roller 8, and a suction belt 14, which receives each end securing tape 12 from the transfer hand 13 and conveys it into an end securing apparatus 19.

The adhesive tape roll 1 is supported by a means (not shown) such that it can rotate around its axis of rotation. The leading end of the adhesive tape 2 is unwound from the adhesive tape roll 1 and wound up around the wind-up roller 8. The wind-up roller 8 is composed of a rotatable roller 10, which is supported on a drive means (not shown) and can rotate around its axis of rotation, and a fixed roller 9, which is located on the rotatable roller 10 and is fixed by a fixing means (not shown). A plurality of cutter blade receiving grooves 11, 11, . . . are formed on the outer circumferential surface of the rotatable roller 10 in accordance with the width of each end securing tape 12. Also, the outer circumferential surface of the rotatable roller 10 is constituted of a material, such as Teflon, from which the end securing tape 12 can be released easily.

As the rotatable roller 10 of the wind-up roller 8 rotates, the adhesive tape 2 is wound around the outer circumferential surface of the wind-up roller 8. At this time, the side end of the adhesive tape 2 is creased by the folding roller 3. The folding roller 3 is supported such that it can rotate around its axis of rotation. The height of the folding roller 3 is smaller by a value equal to the width of the side end, which is to be creased, than the height of the adhesive tape roll 1. Also, the outer circumferential surface of the folding roller 3 is constituted of a material, from which the adhesive tape 2 can be released easily. The adhesive tape 2 threads at an angle of approximately 90° over the folding roller 3 and is thereby creased.

The side end of the adhesive tape 2, which has thus been imparted with a crease, is then folded by the folding plate 4 such that the adhesive surface of the side end of the adhesive tape 2 may be brought onto the adhesive surface of the remaining part of the adhesive tape 2. The folding plate 4 is fixed such that it may be in slide contact with the adhesive tape 2. The folding plate 4 is provided with a plate, which is formed such that the folding angle on the side close to the folding roller 3 may be approximately 90°, the folding angle may increase gradually between the side close to the folding roller 3 and the side close to the wind-up roller 8, and the folding angle on the side close to the wind-up roller 8 may be approximately 180°. The side end of the adhesive tape 2 is folded gradually while the adhesive tape 2 is in slide contact with the folding plate 4 and is moving from the side of the folding roller 3 to the side of the wind-up roller 8.

The adhesive tape 2, the side end of which has been folded by the folding plate 4 in the manner described above, is then wound up around the outer circumferential surface of the wind-up roller 8. The portion of the adhesive tape 2, which has thus been wound up around the outer circumferential surface of the wind-up roller 8, is then cut by the cutting machine 5, and the end securing tapes 12, 12, . . . are thereby prepared. The cutting machine 5 comprises a cutter support 6, which is supported on a drive means (not shown) such that it can move in the directions indicated by the arrows A and A' in FIG. 1, and a cutter 7, which is supported on the cutter support 6 such that it can move up and down in FIG. 1. When the cutting operation of the cutting machine 5 is to be carried out, the cutter 7 moves up, and the cutter support 6 moves in the direction indicated by the arrow A. When the cutter 7 comes into contact with the portion of the adhesive tape 2, which has been wound up around the outer circumferential surface of the wind-up roller 8, the cutter support 6 stops. Thereafter, the cutter 7 moves down and cuts the adhesive tape 2. After the cutting operation is completed, the cutter support 6 moves in the direction indicated by the arrow A' and returns to its original position. The operations described above are repeated, and the plurality of the end securing tapes 12, 12, . . . are thereby prepared sequentially.

Each of the end securing tapes 12, 12, . . . is transferred by the transfer hand 13 from the wind-up roller 8 to the suction belt 14. The transfer hand 13 is supported on a drive means (not shown) such that it can move between the wind-up roller 8 and the suction belt 14. As shown in detail in FIG. 2, the transfer hand 13 grasps the folded part of the end securing tape 12 and transfers the end securing tape 12 in the direction indicated by the arrow. The fixed roller 9 of the wind-up roller 8 is shaped in an approximately semicylindrical form such that the transfer hand 13 can easily grasp the end securing tape 12. Also, as shown in FIG. 2, a discharging brush 26 should preferably be employed in order to discharge the end securing tape 12 when the end securing tape 12 is transferred from the wind-up roller 8 to the suction belt 14. In such cases, the lower end of the end securing tape 12 can be prevented from leaping, and the end securing tape 12 can be transferred smoothly.

After receiving the end securing tape 12 from the transfer hand 13, the suction belt 14 conveys the end securing tape 12 into the end securing apparatus 19. The suction belt 14 comprises an endless belt 16, which is mounted on a rotation shaft 18 supported on a drive means (not shown), and a suction box 17, which is located inside of the space defined by the endless belt 16. The endless belt 16 is provided with a plurality of suction holes 15, 15, . . . The suction belt 14 supports the end securing tape 12 on the endless belt 16 by the air suction force of the suction box 17 and conveys the end securing tape 12 into the end securing apparatus 19. At this time, by adjusting the speed with which the rotation shaft 18 rotates, the intervals, at which the plurality of the end securing tapes 12, 12, . . . are supported on the endless belt 16, can be changed. By changing the intervals, at which the plurality of the end securing tapes 12, 12, . . . are supported on the endless belt 16, the plurality of the end securing tapes 12, 12, . . . can be fed appropriately such that end securing operations can be carried out simultaneously on a plurality of products in the end securing apparatus 19. Also, the feeding of the plurality of the end securing tapes 12, 12, . . . can be adapted to a change in the sizes of the products.

How the end securing apparatus 19 operates will be described hereinbelow.

In the end securing apparatus 19, a web material is slit into three webs 20, 20, 20. The three webs 20, 20, 20 are wound up around cores 21, 21, 21, and three web rolls 22, 22, 22 are thereby obtained. The end securing operations are carried out simultaneously on the three web rolls 22, 22, 22.

Figure 3A:
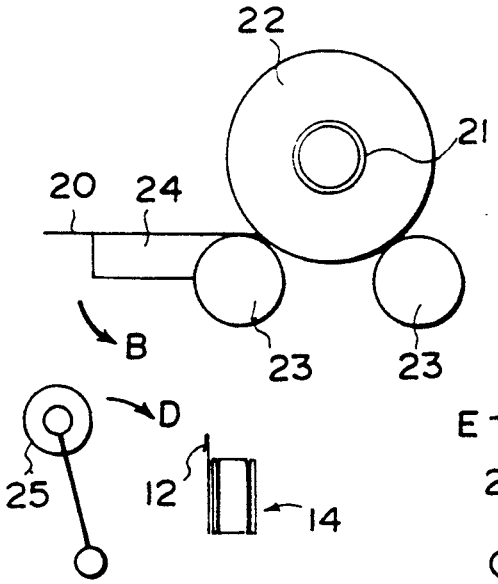
FIGS. 3A and 3B are side views showing how an end securing apparatus operates.
Figure 3B:
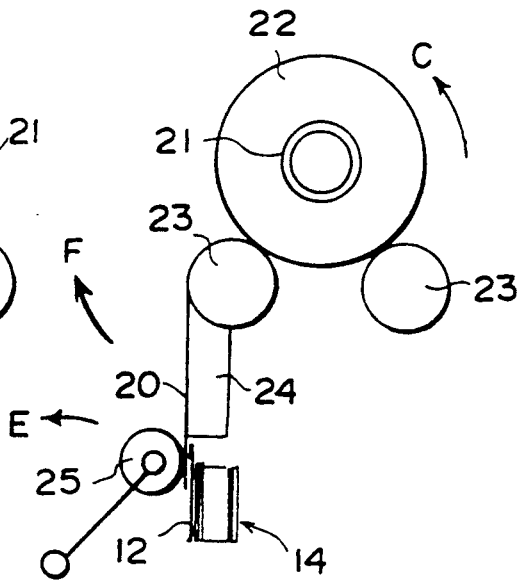

FIGS. 3A and 3B are side views showing how the end securing apparatus 19 operate.

As illustrated in FIG. 1, the end securing apparatus 19 comprises a pair of rotatable rollers 23, 23, which are supported on a drive means (not shown), a suction box 24, which is supported on one of the rotatable rollers 23, 23, and an end securing tape adhering roller 25, which is supported on a drive means (not shown).

As shown in FIG. 3A, as the pair of the rotatable rollers 23, 23 rotate, a predetermined length of each web 20 is wound up around the core 21, and each web roll 22 is thereby obtained. After the predetermined length of the web 20 has been wound up around the core 21, the rotatable rollers 23, 23 stop, and the web 20 is cut. The cut end of the web 20 is supported by the suction box 24 and is moved in the direction indicated by the arrow B in FIG. 3A. The end of the web 20 is stopped at the position shown in FIG. 3B.

Each of the end securing tapes 12, 12, . . . conveyed by the suction belt 14 stops at a predetermined position in the vicinity of the end of the web 20 of each web roll 22. Thereafter, the end securing tape adhering roller 25 moves in the direction indicated by the arrow D in FIG. 3A. As shown in FIG. 3B, the end securing tape adhering roller 25 thus pushes the end of the web 20 of each web roll 22 against each end securing tape 12. In this manner, each end securing tape 12 is adhered to the end of the web 20 of each web roll 22.

Thereafter, the end securing tape adhering roller 25 moves in the direction indicated by the arrow E in FIG. 3B. After the end securing tape adhering roller 25 has thus moved, the rotatable rollers 23, 23 are again rotated, and each web roll 22 is rotated in the direction indicated by the arrow C in FIG. 3B. At this time, the end of the web 20 of each web roll 22, to which the end securing tape 12 has been adhered, is sandwiched between the rotatable rollers 23, 23 and the outer circumferential surface of the web roll 22 and is thereby secured to the outer circumferential surface of the web roll 22. The web roll 22 is then conveyed out of the end securing apparatus 19, and the suction box 24 moves in the direction indicated by the arrow F in FIG. 3B to its original position. By repeating the operations described above, the end securing operation can be carried out sequentially.

As described above, the intervals, with which the end securing tapes 12, 12, . . . are supported on the suction belt 14, can be changed. Therefore, even if the width of the web 20 of each web roll 22 is changed, each end securing tape 12 can easily be adhered to a predetermined position on the end of the web 20 of each web roll 22.

The apparatus for feeding end securing tapes in accordance with the present invention is not limited to the aforesaid embodiment, and may be embodied in various other ways.

For example, in the aforesaid embodiment, the end securing tapes 12, 12, . . . are fed to the end securing apparatus 19, in which the web material is slit into three webs 20, 20, 20 and wound up as the three web rolls 22, 22, 22, and the end securing operations are carried out simultaneously on three web rolls 22, 22, 22. Alternatively, the web material may be slit into four or five webs. As another alternative, the end securing operations may be carried out products other than the web rolls.

Also, instead of the discharging brush 26 being employed, any of other discharging means, such as a discharging bar, may be employed. In cases where the end securing tapes 12, 12, . . . are constituted of a material which is not easily charged electrostatically, the discharging brush 26 need not necessarily be employed.

Additionally, in the aforesaid embodiment, the non-adhesive surface is formed at the side end of the adhesive tape 2 by folding the side end. Alternatively, an adhesive tape may be employed which is already provided with such a non-adhesive surface.

As described above, the apparatus for feeding end securing tapes in accordance with the present invention can be embodied in various other ways such that the effects of the apparatus may not be lost.

What is claimed is:

1. An apparatus for feeding end securing tapes, wherein a plurality of end securing tapes are sequentially fed into an end securing apparatus which simultaneously carries out end securing operations on a plurality of products, the apparatus for feeding end securing tapes comprising:

i) a wind-up means for winding up an adhesive tape, which has a non-adhesive surface, ii) a cutting means for cutting said adhesive tape, which has been wound up around said wind-up means, into a predetermined size, and thereby forming a plurality of end securing tapes, iii) a transfer means for receiving said end securing tapes, which have been formed by said cutting means, from said wind-up means, and transferring the received end securing tapes, and iv) a conveyance means for receiving the plurality of said end securing tapes at predetermined intervals from said transfer means, and conveying the plurality of said end securing tapes, which have been arrayed at said predetermined intervals, into the end securing apparatus.

2. An apparatus as defined in claim 1 wherein said wind-up means is constituted such that said adhesive tape, which has the non-adhesive surface, may be wound up around an outer circumferential surface of a roller capable of rotating around an axis of rotation.

3. An apparatus as defined in claim 1 wherein said cutting means is provided with a movable cutter.

4. An apparatus as defined in claim 1 wherein said transfer means is provided with a transfer hand.

5. An apparatus as defined in claim 1 wherein said conveyance means is provided with a suction belt, on which the plurality of said end securing tapes are supported at said predetermined intervals and which conveys said end securing tapes into said end securing apparatus.

6. An apparatus for feeding end securing tapes, wherein a plurality of end securing tapes are sequentially fed into an end securing apparatus which simultaneously carries out end securing operations on a plurality of products, the apparatus for feeding end securing tapes comprising:

i) a folding means for folding a side end of an adhesive tape such that an adhesive surface of said side end of said adhesive tape may be brought onto an adhesive surface of the remaining part of said adhesive tape, said folding being carried out when said adhesive tape is unwound from a roll of said adhesive tape, ii) a wind-up means for winding up said adhesive tape, said side end of which has been folded by said folding means, iii) a cutting means for cutting said folded adhesive tape, which has been wound up around said wind-up means, into a predetermined size, and thereby forming a plurality of end securing tapes, iv) a transfer means for receiving said end securing tapes, which have been formed by said cutting means, from said wind-up means, and transferring the received end securing tapes, and v) a conveyance means for receiving the plurality of said end securing tapes at predetermined intervals from said transfer means, and conveying the plurality of said end securing tapes, which have been arrayed at said predetermined intervals, into the end securing apparatus.

7. An apparatus as defined in claim 6 wherein said folding means is constituted such that it may be in slide contact with said side end of said adhesive tape and may gradually fold said side end.

8. An apparatus as defined in claim 6 wherein said wind-up means is constituted such that said adhesive tape, which has the non-adhesive surface at said side end, may be wound up around an outer circumferential surface of a roller capable of rotating around an axis of rotation.

9. An apparatus as defined in claim 6 wherein said cutting means is provided with a movable cutter.

10. An apparatus as defined in claim 6 wherein said transfer means is provided with a transfer hand.

11. An apparatus as defined in claim 6 wherein said conveyance means is provided with a suction belt, on which the plurality of said end securing tapes are supported at said predetermined intervals and which conveys said end securing tapes into said end securing apparatus.

12. An apparatus for feeding end securing tapes, wherein a plurality of end securing tapes are sequentially fed into an end securing apparatus which simultaneously carries out end securing operations on a plurality of products, the apparatus for feeding end securing tapes comprising:

i) a wind-up means for winding up an adhesive tape, which has a non-adhesive surface, ii) a cutting means for cutting said adhesive tape, which has been wound up around said wind-up means, into a predetermined size, and thereby forming a plurality of end securing tapes, iii) a transfer means for receiving said end securing tapes, which have been formed by said cutting means, from said wind-up means, and transferring the received end securing tapes, iv) a conveyance means for receiving the plurality of said end securing tapes at predetermined intervals from said transfer means, and conveying the plurality of said end securing tapes, which have been arrayed at said predetermined intervals, into the end securing apparatus, and v) a discharging means for electrostatically discharging the end securing tapes during transfer from said wind-up means to said conveyance means by said transfer means.

* * * * *